US010504479B2

(12) United States Patent
Yoshiga

(10) Patent No.: US 10,504,479 B2
(45) Date of Patent: Dec. 10, 2019

(54) DISPLAY DEVICE

(71) Applicant: InnoLux Corporation, Miao-Li County (TW)

(72) Inventor: Masahiro Yoshiga, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 171 days.

(21) Appl. No.: 15/708,163

(22) Filed: Sep. 19, 2017

(65) Prior Publication Data

US 2019/0088232 A1 Mar. 21, 2019

(51) Int. Cl.
*G09G 5/00* (2006.01)
*G09G 3/20* (2006.01)

(52) U.S. Cl.
CPC ..... *G09G 5/003* (2013.01); *G09G 3/20* (2013.01); *G09G 2300/0857* (2013.01); *G09G 2310/0254* (2013.01); *G09G 2310/06* (2013.01); *G09G 2310/08* (2013.01); *G09G 2320/0247* (2013.01)

(58) Field of Classification Search
CPC ..... G09G 5/003; G09G 2320/0247; G09G 2310/06; G09G 2310/0254; G09G 2310/08
See application file for complete search history.

(56) References Cited

U.S. PATENT DOCUMENTS

2012/0169753 A1* 7/2012 Murakami ..... G09G 3/3659 345/560
2013/0033509 A1 2/2013 Yamashita

* cited by examiner

*Primary Examiner* — Alexander Eisen
*Assistant Examiner* — Kebede T Teshome
(74) *Attorney, Agent, or Firm* — Winston Hsu

(57) ABSTRACT

The display panel includes a source line, a common voltage line, a gate line, and a pixel circuit. The pixel circuit includes a first capacitor, a first transistor, a sample circuit, and a memory circuit. The first capacitor is coupled to the common voltage line. The first transistor is coupled to the source line and the first capacitor. The sample circuit includes a second transistor, and the second transistor is coupled to the source line and the first capacitor. The memory circuit is coupled to the first transistor, the sample circuit, and the gate line.

16 Claims, 10 Drawing Sheets

DISPLAY DEVICE

BACKGROUND OF THE DISCLOSURE

1. Field of the Disclosure

The present disclosure relates to a display device, and more particularly to a display device capable of reducing flickers.

2. Description of the Prior Art

Display devices have been widely used in a variety of applications, such as smart phones, personal computers, and electronic book readers. However, according to usage scenarios of the applications, different types of display devices may be chosen. To generate a desired image, a display device usually arranges its pixels in an array, and the pixels are updated to receive the pixel voltages separately and sequentially according to the image data. Then the pixels will display different levels of brightness according to the pixel voltages received.

In some situations, the display device may display a still image. In this case, power is wasted if the pixels are updated with the same data. Therefore, memory in pixel (MIP) circuits are usually used to store the pixel voltages of the image data so the pixels can be refreshed accordingly without repeated updating operations, reducing the power consumption. However in prior art, charges stored by the memory in pixels will dissipate after a long duration, and the pixel voltages will drop, causing flickers when displaying images.

SUMMARY OF THE DISCLOSURE

One embodiment of the present disclosure discloses a display device. The display device includes a display panel, and the display panel includes a source line, a common voltage line, a gate line, and a pixel circuit. The pixel circuit includes a first capacitor, a first transistor, a sample circuit, and a memory circuit.

The first capacitor has a first terminal and a second terminal, wherein the first terminal of the first capacitor is coupled to the common voltage line. The first transistor has a first terminal, a second terminal and a control terminal, wherein the first terminal of the first transistor is coupled to the source line, and the second terminal of the first transistor is coupled to the second terminal of the first capacitor.

The sample circuit includes a second transistor having a first terminal, a second terminal and a control terminal. The first terminal of the second transistor is coupled to the source line, and the control terminal of the second transistor is coupled to the second terminal of the first capacitor.

The memory circuit is coupled to the control terminal of the first transistor, the sample circuit, and the gate line.

Another embodiment of the present disclosure discloses a display panel. The display panel includes a source line, a common voltage line, a gate line, and a pixel circuit. The pixel circuit includes a first capacitor, a first transistor, a sample circuit, and a memory circuit.

The first capacitor has a first terminal and a second terminal, wherein the first terminal of the first capacitor is coupled to the common voltage line. The first transistor has a first terminal, a second terminal and a control terminal, wherein the first terminal of the first transistor is coupled to the source line, and the second terminal of the first transistor is coupled to the second terminal of the first capacitor.

The sample circuit includes a second transistor having a first terminal, a second terminal and a control terminal. The first terminal of the second transistor is coupled to the source line, and the control terminal of the second transistor is coupled to the second terminal of the first capacitor.

The memory circuit is coupled to the control terminal of the first transistor, the sample circuit, and the gate line.

These and other objectives of the present disclosure will no doubt become obvious to those of ordinary skill in the art after reading the following detailed description of the embodiment that is illustrated in the various figures and drawings.

DETAILED DESCRIPTION

Figure 1:
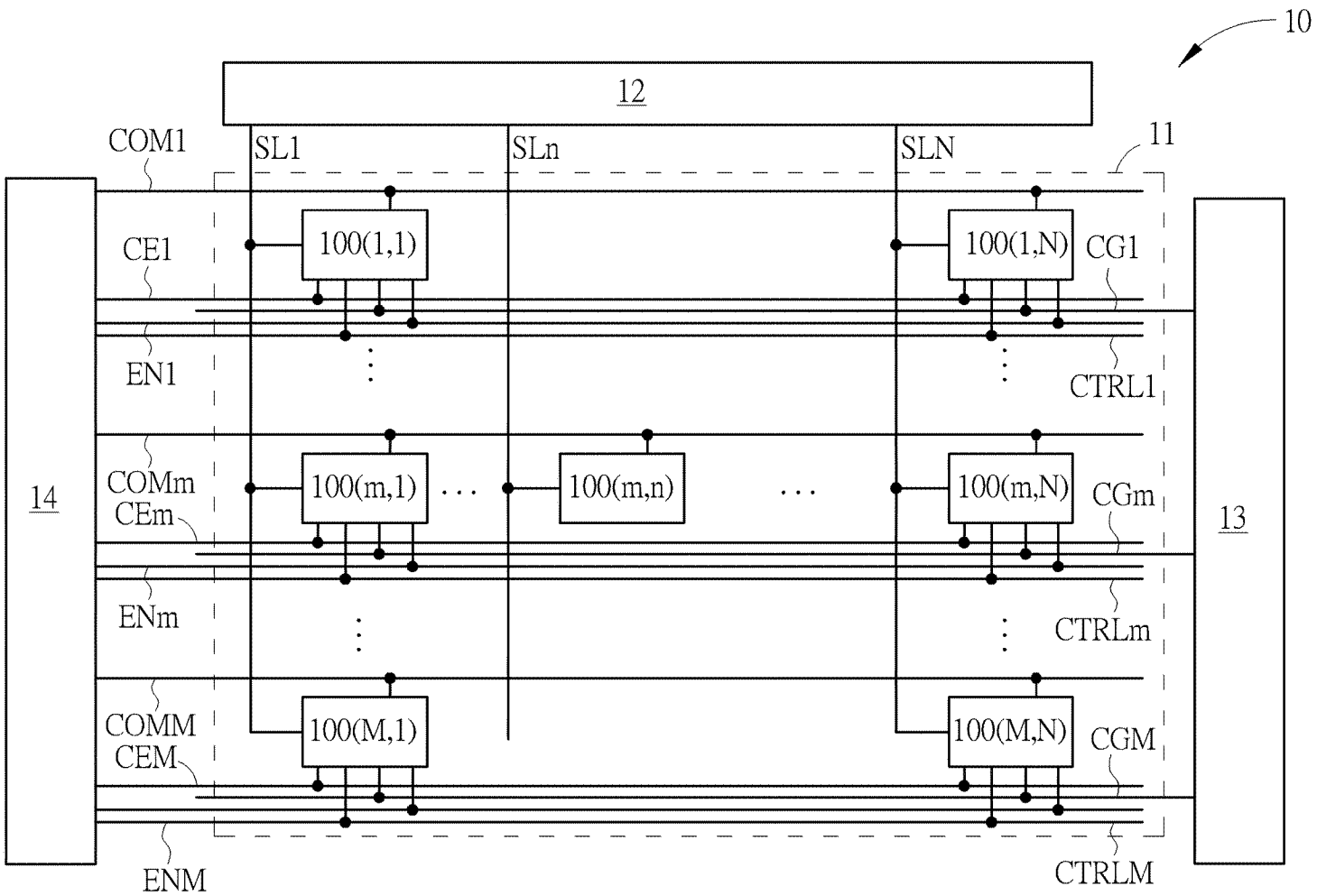
FIG. 1 shows a display device according to one embodiment of the present disclosure.

FIG. 1 shows a display device 10 according to one embodiment of the present disclosure. The display device 10 includes a source driver 12, a gate driver 13, a control driver 14, and a display panel. The display panel includes a pixel array 11, and the pixel array 11 defines an active area of the display device 10.

The pixel array 11 includes N source lines SL1 to SLN, M common voltage lines COM1 to COMM, M gate lines CG1 to CGM, M first control lines CE1 to CEM, M second control lines EN1 to ENM, M third control lines CTRL1 to CTRLM and M×N pixel circuits 100(1,1) to 100(M,N) arranged in a matrix. M and N are integers greater than 1. Each of pixel circuits 100(1,1) to 100(M,N) is coupled to a corresponding source line, a corresponding common voltage line, a corresponding gate line, a corresponding first control line, a corresponding second control line, and a corresponding third control line.

In FIG. 1, pixel circuits in the same row can be coupled to the same common voltage line, the same gate line, the same first control line, the same second control line, the same third control line and different source lines.

For example, the pixel circuits 100(1,1) to 100(1,N) are disposed in the same row, and the pixel circuits 100(M,1) to 100(M,N) are disposed in the same row. The pixel circuits 100(1,1) to 100(1,N) are coupled to the common voltage line COM1, the gate line CG1, the first control line CE1, the second control line EN1, and the third control line CTRL1.

However, the pixel circuit 100(1,1) is coupled to the source line SL1 while the pixel circuit 100(1,N) is coupled to the source line SLN. Similarly, the pixel circuits 100(M,1) to 100(M,N) are coupled to the common voltage line COMM, the gate line CGM, the first control line CEM, the second control line ENM, and the third control line CTRLM. However, the pixel circuit 100(M,1) is coupled to the source line SL1 while the pixel circuit 100(M,N) is coupled to the source line SLN.

The source driver 12 can drive the source lines SL1 to SLN, the gate driver 13 can drive the gate lines CG1 to CGM, and the control driver 14 can drive the first control lines CG1 to CGM, the second control lines EN1 to ENM, and the third control lines CTRL1 to CTRLM. In some embodiments, the gate driver 13 and the control driver 14 are integrated, but that is not limited thereto. In some embodiments, the source driver 12, the gate driver 13 and the control driver 14 may be integrated. In some embodiments, the control driver 14 may include different control circuits for controlling different control lines. Also, the common voltage lines COM1 to COMM may be driven by the control driver 14 or another control driver according to the system requirements in some embodiments.

Figure 2:
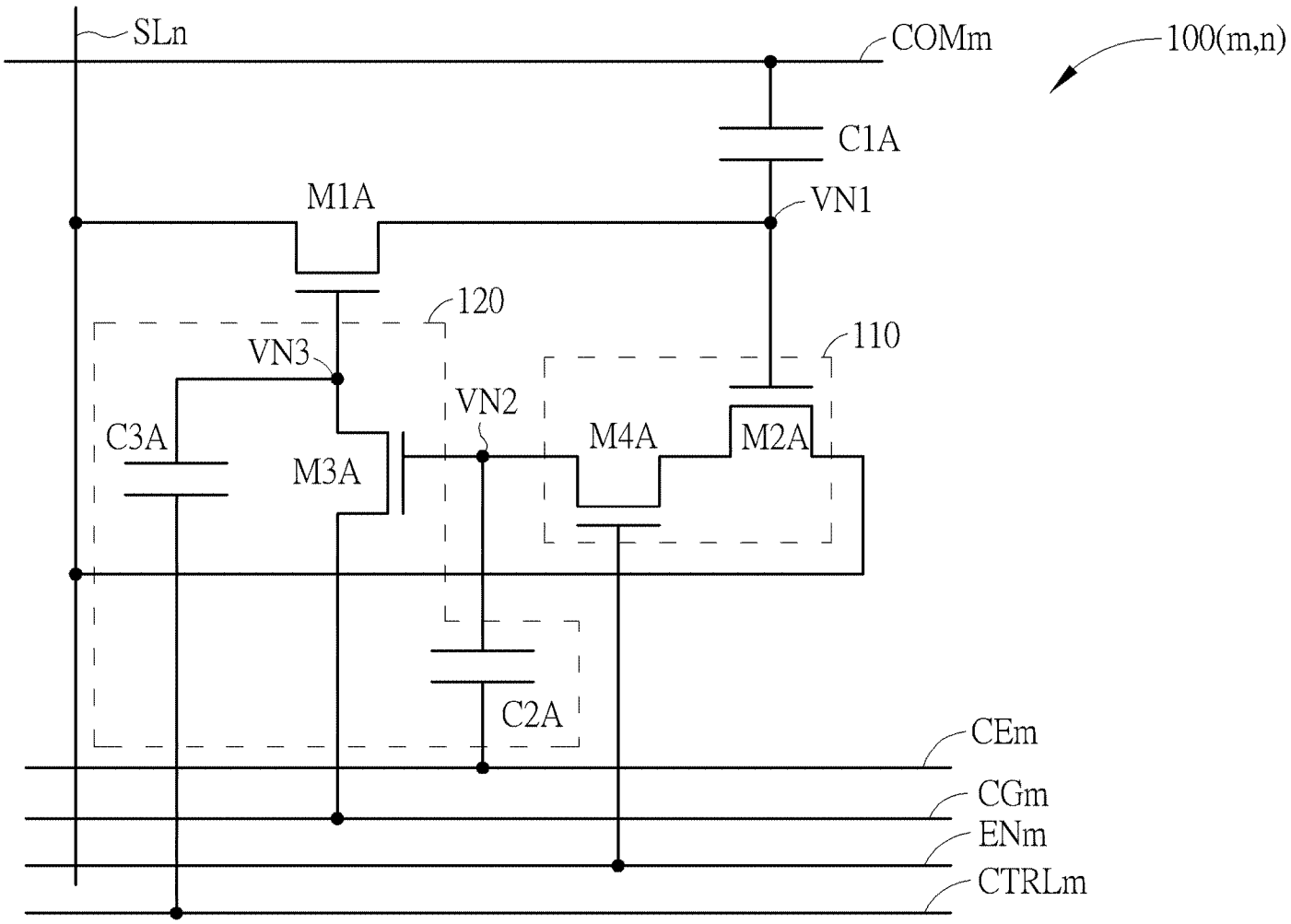
FIG. 2 shows the block diagram of the pixel circuit in the display driver in FIG. 1.

As is made as an example, FIG. 2 shows the block diagram of the pixel circuit 100(*m,n*) in the display device 10, wherein m is a positive integer no greater than M, and n is a positive integer no greater than N. The pixel circuit 100(*m,n*) includes a first capacitor C1A, a first transistor M1A, a sample circuit 110, and a memory circuit 120.

The sample circuit 110 is coupled to the first capacitor C1A and can sample the voltage of the first capacitor C1A. For example, but it is not limited thereto, the sample circuit 110 includes a second transistor M2A and a fourth transistor M4A. The memory circuit 120 is coupled to the first transistor M1A, the sample circuit 110 and the gate line. For example, but it is not limited thereto, the memory circuit 120 includes a second capacitor C2A, a third transistor M3A and a third capacitor C3A. The memory circuit 120 can preserve internal voltages with the second capacitor C2A and the third capacitor C3A.

The first capacitor C1A has a first terminal and a second terminal. The first terminal of the first capacitor C1A is coupled to the common voltage line COMm. The second capacitor C2A has a first terminal and a second terminal. The first terminal of the second capacitor C2A is coupled to the first control line CEm. The third capacitor C3A has a first terminal and a second terminal. The first terminal of the third capacitor C3A is coupled to the third control line CTRLm.

The first transistor M1A has a first terminal, a second terminal, and a control terminal. The first terminal of the first transistor M1A is coupled to the source line SLn, the second terminal of the first transistor M1A is coupled to the second terminal of the first capacitor C1A, the control terminal of the first transistor M1A is coupled to the second terminal of the third capacitor C3A.

The second transistor M2A has a first terminal, a second terminal, and a control terminal. The first terminal of the second transistor M2A is coupled to the source line SLn, and the control terminal of the second transistor M2A is coupled to the second terminal of the first transistor M1A.

The fourth transistor M4A has a first terminal, a second terminal, and a control terminal. The first terminal of the fourth transistor M4A is coupled to the second terminal of the second capacitor C2A, the second terminal of the fourth transistor M4A is coupled to the second terminal of the second transistor M2A, and the control terminal of the fourth transistor M4A is coupled to the second control line ENm.

The third transistor M3A has a first terminal, a second terminal, and a control terminal. The first terminal of the third transistor M3A is coupled to the control terminal of the first transistor M1A, the second terminal of the third transistor M3A is coupled to the gate line CGm, and the control terminal of the third transistor M3A is coupled to the second terminal of the second capacitor C2A.

In pixel circuit 100 (*m,n*), the first capacitor C1A can store the corresponding image data, that is, the pixel data voltage corresponding to the image data to be shown. For example, the common voltage line COMm can provide a reference voltage to the first terminal of the first capacitor C1A, and the second terminal of the first capacitor C1A can receive the data voltage through the first transistor M1A from the source line SLn during a write process of the pixel circuit 100 (*m,n*). In this case, the pixel voltage received by the pixel circuit 100 (*m,n*) would be the voltage difference between the reference voltage and the data voltage.

In some embodiments, the pixel circuit 100 (*m,n*) may be compatible with 2-bit image data, that is, the pixel circuit 100 (*m,n*) may support four different grey levels according to the data voltage stored. For example, the data voltage can be one of the first data voltage VS0, the second data voltage VS1, the third data voltage VS2, and the fourth data voltage VS3, and each data voltage is corresponding to one of the image data "00", "01", "10", and "11".

In some embodiments, the fourth data voltage VS3 can be greater than the third data voltage VS2, the third data voltage VS2 can be greater than the second data voltage VS1, and the second data voltage VS1 can be greater than the first data voltage VS0. For example, the first data voltage VS0 can be 0V, the second data voltage VS1 can be 1V, the third data voltage VS2 can be 2V, and the fourth data voltage VS3 can be 3V.

Figure 3:
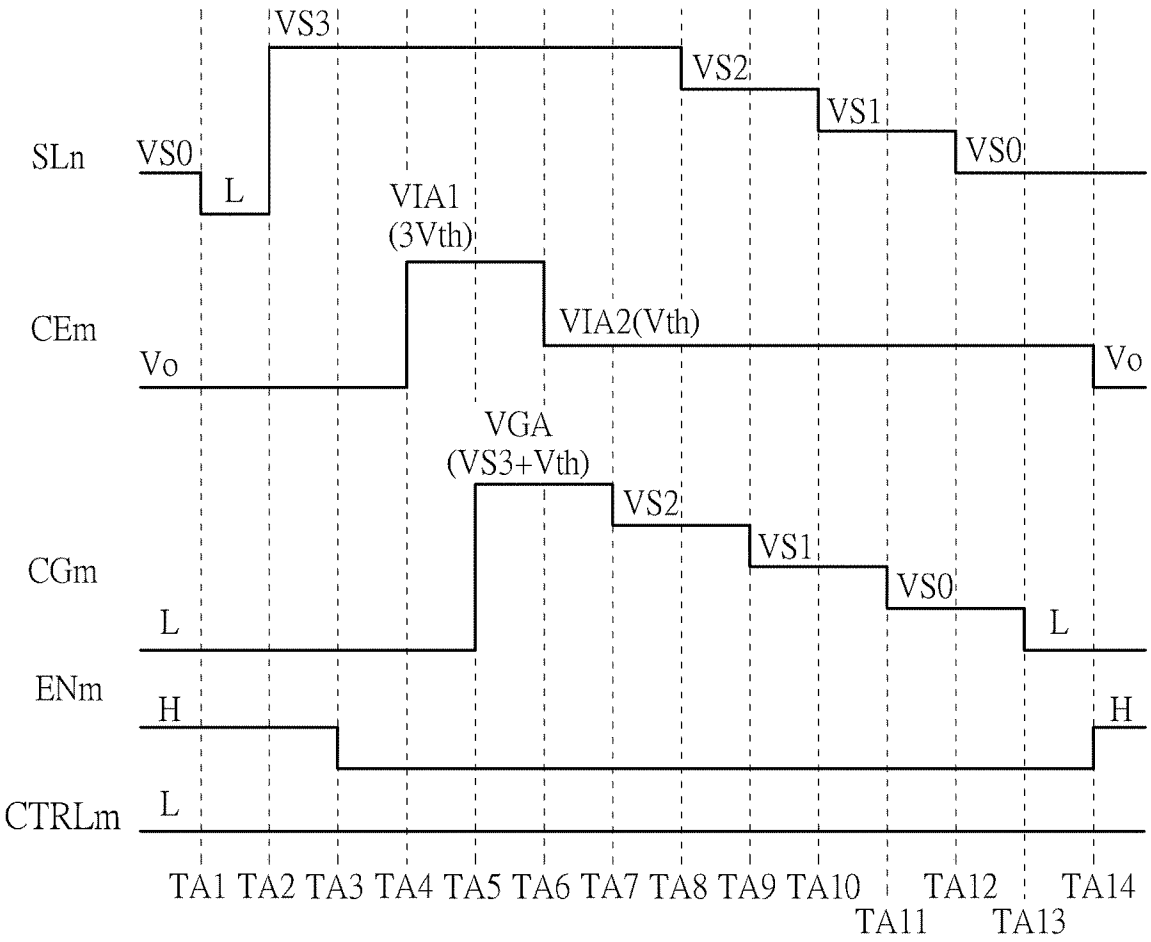
FIG. 3 shows a timing diagram of the signals received by the pixel circuit in FIG. 2 during the refreshing processes according to one embodiment.
Figure 4:
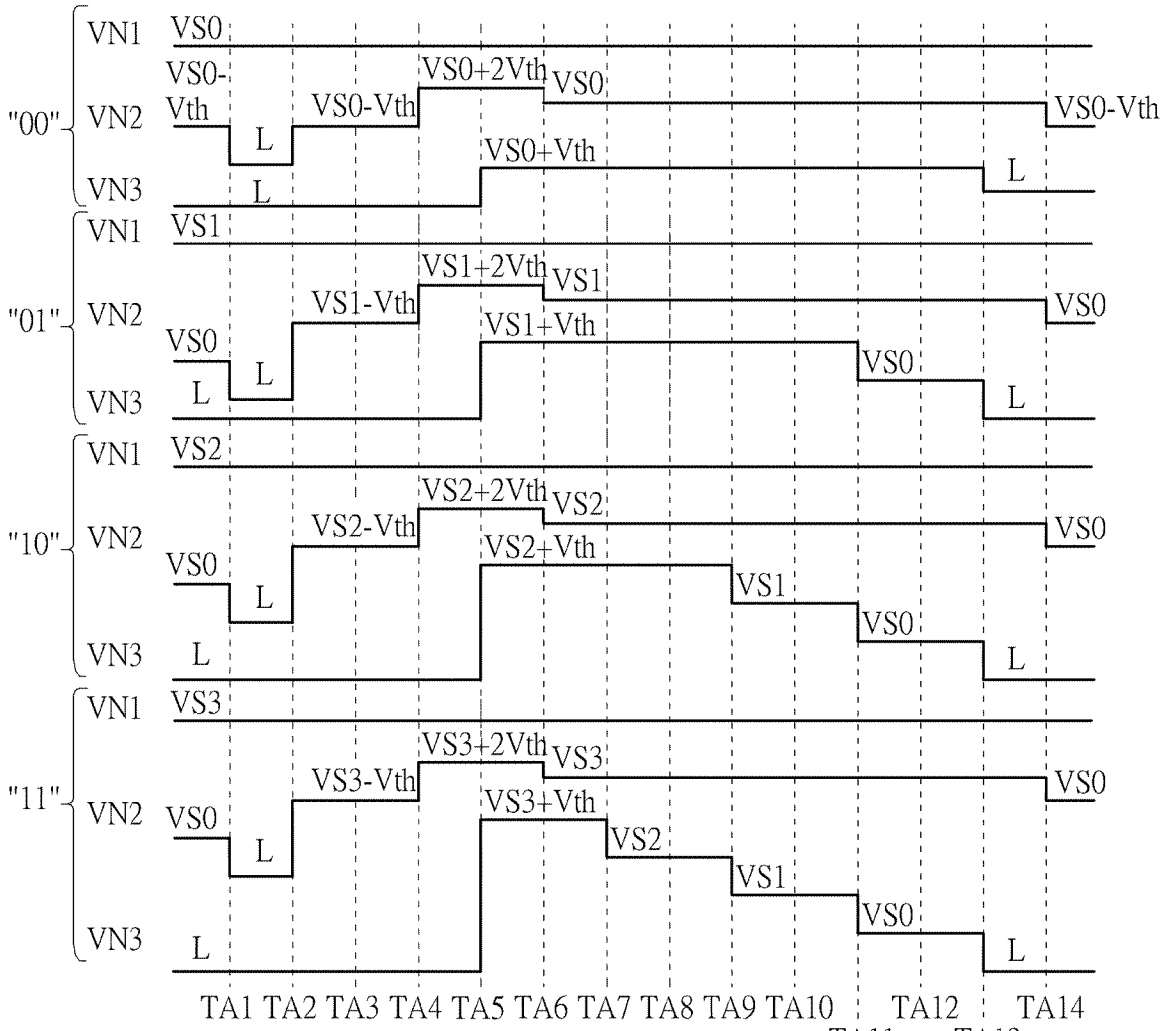
FIG. 4 shows the voltages of the first capacitor and the second capacitor with the image data being "11", "10", "01", and "00" according to the waveform shown in FIG. 3.

FIG. 3 shows a timing diagram of the signals received by the pixel circuit 100 (*m,n*) during the a refreshing processes with the data voltage being at the same polarity. FIG. 4 shows the voltages VN1 of the second terminal of the first capacitor C1A, the voltages VN2 of the second terminal of the second capacitor C2A, and the voltage VN3 of the control terminal of the first transistor M1A with the image data stored in the pixel circuit 100 (*m, n*) being "11", "10", "01", and "00" according to the waveform shown in FIG. 3.

In FIG. 3, before the refreshing process starts at time TA1, the pixel circuit 100(*m,n*) has been written with the desired image data "11", "10", "01", or "00"; therefore, the voltage VN1 of the second terminal of the first capacitor C1A is at the data voltage VS0, VS1, VS2, or VS3 according to the image data stored. Also, before the refreshing process starts, the pixel circuit 100(*m,n*) can be at a suspend mode. At the suspend mode, the first transistor M1A of the pixel circuit 100(*m,n*) is turned off. In this case, the voltage of the source line SLn can be at the first data voltage VS0 (or other data voltages according to the previous operations), the voltage of the gate line CGm can be at the low voltage L, the voltage of the first control line CEm can be at the reference voltage V0, the voltage of the second control line ENm can be at the high voltage H, and the voltage of the third control line CTRLm can be at the low voltage L.

In some embodiments, the reference voltage V0 can be the system ground voltage, for example, in the present embodiment, the reference voltage V0 can be 0V. The low voltage L is lower than the reference voltage V0 and is lower than the lowest data voltage. The high voltage H is higher than the reference voltage V0 and is higher than the highest data voltage.

During the refreshing process as shown in FIG. 3, the third control line CTRLm remains at the low voltage L, so the third capacitor C3A can be used to preserve the voltage VN3 of the control terminal of the first transistor M1A when the third transistor M3A is turned off.

At time TA1, the voltage of the source line SLn is changed to the low voltage L. Since the low voltage L is even lower than the lowest data voltage, the second transistor M2A and the fourth transistor M4A can all be turned on. Therefore, the voltage VN2 of the second terminal of the second capacitor C2A is at the low voltage L, and the first transistor M1A is still turned off.

At time TA2, the voltage of the source line SLn is changed from the low voltage L to the fourth data voltage VS3. In this case, the fourth transistor M4A remains turned on because the second control line ENm is at the high voltage H higher than the four data voltages VS0, VS1, VS2, and VS3.

Also, since the voltage VN2 of the second terminal of the second capacitor C2A was at the low voltage L previously, the second transistor M2A may be turned on firstly. However, the second transistor M2A will finally be turned off when the voltage VN2 of the second terminal of the second capacitor C2A is charged to a voltage lower than the voltage VN1 of the second terminal of the first capacitor C1A by the threshold voltage Vth of the second transistor M2A.

For example, if the voltage VN1 of the second terminal of the first capacitor C1A is at the first data voltage VS0, then the voltage VN2 of the second terminal of the second capacitor C2A would be at the voltage (VS0−Vth). Or, if the voltage VN1 of the second terminal of the first capacitor C1A is at the fourth data voltage VS3, then the voltage VN2 of the second terminal of the second capacitor C2A would be at the voltage (VS3−Vth).

At time TA3, the voltage of the second control line ENm is changed from the high voltage H to the low voltage L. Therefore, the fourth transistor M4A would be turned off.

At time TA4, the voltage of the first control line CEm is changed from the reference voltage V0 to a first intermediate voltage VIA1. The first intermediate voltage VIA1 can be substantially equal to three times the threshold voltage of the first transistor M1A. In some embodiments, the transistors M1A to M4A may substantially have the same threshold voltage. That is, the first intermediate voltage VIA1 can be 3Vth.

Since the fourth transistor M4A remains turned off, there is no discharging path for the second terminal of the second capacitor C2A. Therefore, the voltage VN2 at the second terminal of the second capacitor C2A would be raised by three times the threshold voltage Vth according to the voltage change of the first control line CEm.

For example, if the pixel circuit 100(*m,n*) stores the image data "11", then the voltage VN2 of the second terminal of the second capacitor C2A would be at the fourth data voltage VS3 plus two times the threshold voltage Vth, that is, (VS3+2Vth), as shown in FIG. 4. Or, if the pixel circuit 100(*m,n*) stores the image data "00", then the voltage VN2 of the second terminal of the second capacitor C2A would be at (VS0+2Vth).

At time TA5, the voltage of the gate line CGm is changed from the low voltage L to a push voltage VGA. In some embodiments, the push voltage VGA can be substantially equal to the fourth data voltage VS3 plus the threshold voltage Vth, that is, (VS3+Vth). In this case, the voltage VN3 of the control terminal of the first transistor M1A would be raised according to the stored image data as shown in FIG. 4.

For example, if the pixel circuit 100(*m,n*) stores the image data "11", then the third transistor M3A would be turned on, and the voltage VN3 of the control terminal of the first transistor M1A would be at the fourth data voltage VS3 plus the threshold voltage Vth, that is, (VS3+Vth). Since the voltage VN3 of the control terminal of the first transistor M1A is higher than the voltage of the source line SLn, which is at the fourth data voltage VS3, the first transistor M1A can be turned on, and the second terminal of the first capacitor C1A would receive the fourth data voltage VS3. Therefore, the pixel circuit 100(*m,n*) storing image data "11" can be refreshed.

However, if the pixel circuit 100(*m,n*) stores the image data "10", then the third transistor M3A may be finally turned off when the voltage VN3 of the control terminal of the first transistor M1A is raised to a voltage lower than the voltage VN2 of the second terminal of the second capacitor C2A by the threshold voltage Vth, that is (VS2+Vth), which is lower than the fourth data voltage VS3. Therefore, the pixel circuit 100(*m,n*) storing image data "10" will not be refreshed at time TA5. Similarly, if the pixel circuit 100 (*m, n*) stores the image data "01", then the voltage VN3 of the control terminal of the first transistor M1A would be (VS1+Vth), and the pixel circuit 100(*m,n*) will not be refreshed. If the pixel circuit 100(*m,n*) stores the image data "00", then the voltage VN3 of the control terminal of the first transistor M1A would be (VS0+Vth), and the pixel circuit 100(*m,n*) will not be refreshed.

At time TA6, the voltage of the first control line CEm is changed from the first intermediate voltage VIA1 to a second intermediate voltage VIA2. The second intermediate voltage can be substantially equal to the threshold voltage Vth. In this case, voltage VN2 of the second terminal of the second capacitor C2A would be dropped by two threshold voltages 2Vth as shown in FIG. 4, and the third transistor M3A would be turned off.

At time TA7, the voltage of the gate line CGm is changed from the push voltage VGA to the third data voltage VS2. In this case, if the pixel circuit 100(*m,n*) stores the image data "11", then the voltage VN2 of the second terminal of the second capacitor C2A is at the fourth data voltage VS3, which is higher than the voltage of the gate line CGm, so the third transistor M3A would be turned on. Therefore, the control terminal of the first transistor M1A will receive the third data voltage VS2 from the gate line CGm through the third transistor M3A, turning off the first transistor M1A. However, if the pixel circuit 100(*m,n*) stores the image data "10", "01", or "00", then the third transistor M3A would remain tuned off.

At time TA8, the voltage of the source line SLn is changed from the fourth data voltage VS3 to the third data voltage VS2. In this case, if the pixel circuit 100(*m,n*) stores the image data "10", then the voltage VN3 of the control terminal of the first transistor M1A is at (VS2+Vth), which is higher than the voltage of the source line SLn. Therefore, the first transistor M1A would be turned on, and the second terminal of the first capacitor C1A will receive the third data voltage VS2 from the source line SLn through the first transistor M1A, and the pixel circuit 100(*m,n*) can be refreshed.

However, if the pixel circuit 100(*m,n*) stores the image data "11", "01", or "00", then the first transistor M1A would remain turned off, and the pixel circuit 100(*m,n*) will not be refreshed.

At time TA9, the voltage of the gate line CGm is changed from the third data voltage VS2 to the second data voltage VS1. In this case, if the pixel circuit 100(*m,n*) stores the image data "10", then the voltage VN2 of the second terminal of the second capacitor C2A is at the third data voltage VS2, which is higher than the voltage of the gate line CGm, so the third transistor M3A would be turned on. Therefore, the control terminal of the first transistor M1A will receive the second data voltage VS1 from the gate line CGm through the third transistor M3A, turning off the first transistor M1A. Similarly, if the pixel circuit 100(*m,n*) stores the image data "11", the third transistor M3A would remain turned on, and the first transistor M1A would remain turned off.

However, if the pixel circuit 100(*m,n*) stores the image data "01", or "00", then the third transistor M3A would remain tuned off.

At time TA10, the voltage of the source line SLn is changed from the third data voltage VS2 to the second data voltage VS1. In this case, if the pixel circuit 100(*m,n*) stores the image data "01", then the voltage VN3 of the control terminal of the first transistor MIA is at (VS1+Vth), which is higher than the voltage of the source line SLn, so the first transistor M1A would be turned on. Therefore, the second terminal of the first capacitor C1A will receive the second data voltage VS1 from the source line SLn through the first transistor M1A, and the pixel circuit 100(*m,n*) can be refreshed.

However, if the pixel circuit 100(*m,n*) stores the image data "11", "10", or "00", then the first transistor M1A would remain turned off, and the pixel circuit 100(*m,n*) will not be refreshed.

At time TA11 the voltage of the gate line CGm is changed from the second data voltage VS1 to the first data voltage VS0. In this case, if the pixel circuit 100(*m,n*) stores the image data "01", then the voltage VN2 of the second terminal of the second capacitor C2A is at the second data voltage VS1, which is higher than the voltage of the gate line CGm. Therefore, the third transistor M3A would be turned on, and the control terminal of the first transistor M1A will receive the first data voltage VS0 from the gate line CGm through the third transistor M3A, turning off the first transistor M1A. Similarly, if the pixel circuit 100(*m,n*) stores the image data "11" or "10", the third transistor M3A would remain turned on, and the first transistor M1A would remain turned off.

However, if the pixel circuit 100(*m,n*) stores the image data "00", then the third transistor M3A would remain tuned off.

At time TA12, the voltage of the source line SLn is changed from the second data voltage VS1 to the first data voltage VS0. In this case, if the pixel circuit 100(*m,n*) stores the image data "00", then the voltage VN3 of the control terminal of the first transistor M1A is at (VS0+Vth), which is higher than the voltage of the source line SLn. Therefore, the first transistor M1A would be turned on, and the second terminal of the first capacitor C1A will receive the first data voltage VS0 from the source line SLn through the first transistor M1A, and the pixel circuit 100(*m,n*) can be refreshed.

However, if the pixel circuit 100(*m,n*) stores the image data "11", "10", or "01", then the first transistor M1A would remain turned off, and the pixel circuit 100(*m,n*) will not be refreshed.

At time TA13, the voltage of the gate line CGm is changed from the first data voltage VS0 to the low voltage L. In this case, the third transistor M3A would be turned on, and the control terminal of the first transistor M1A would receive the low voltage L from the gate line CGm through the third transistor M3A. Therefore, the first transistor M1A can be turned off if the pixel circuit 100 (*m,n*) stores the image data "00". And the first transistor M1A can remain turned off if the pixel circuit 100(*m, n*) stores the image data "11", "10", "01".

At time TA14, the voltage of the first control line CEm is changed from the second intermediate voltage VIA2 to the reference voltage V0, and the voltage of the second control line ENm is changed from the low voltage L to the high voltage H. Therefore, the pixel circuit 100(*m,n*) enters the suspend mode again.

In some embodiments, by applying the same waveforms shown in FIG. 3 to the source lines SL1 to SLN, the gate lines CG1 to CGM, the first control lines CE1 to CEM, the second control lines EN1 to ENM, and the third control lines CTRL1 to CTRLM, the pixel circuits 100(1,1) to 100(M,N) can all be refreshed simultaneously during the same refreshing process.

During the refreshing process, the third control line CTRLm can remain at the low voltage L, and the third capacitor C3A can be used to preserve the voltage VN3 when the third transistor M3A is turned off, ensuring the first transistor M1A can be turned on or turned off accordingly.

Also, since the data voltage stored in the first capacitor C1A is sampled by the control terminal of the second transistor M2A at time TA2, the charges stored in the first capacitor C1A can hardly dissipate during the refreshing processes, reducing the flickers.

In addition, although voltages of the signal lines are mostly changed at different times in FIG. 3, some of the signal lines may change the voltage at the same time for further shorten the refreshing process.

Also, to reduce the ageing of the materials used by the pixel circuit 100(*m,n*), for instance the liquid crystal material, the polarity of the data voltage received by the pixel circuit 100(*m,n*) may be alternated in different periods. For example, in some embodiments, when the pixel circuit 100(*m,n*) is in a first polarity mode, the voltage between the first terminal of the first capacitor C1A and the second terminal of the first capacitor C1A can be set to be a first data voltage VS0, a second data voltage VS1, a third data voltage VS2, or a fourth data voltage VS3. Whereas, when the pixel circuit 100(*m,n*) is in a second polarity mode, the voltage between the first terminal of the first capacitor C1A and the second terminal of the first capacitor C1A can be set to be a fifth data voltage VS0', a sixth data voltage VS1', a seventh data voltage VS2', or an eighth data voltage VS3'.

In some embodiments, the first data voltage VS0 and the eighth data voltage VS3' may have the same magnitude but different polarities. In the present disclosure, the phrase "magnitude of a data voltage" represents the absolute value of the difference between the data voltage and the reference voltage. The second data voltage VS1 and the seventh data voltage VS2' may have the same magnitude but different polarities. The third data voltage VS2 and the sixth data voltage VS1' may have the same magnitude but different polarities. The fourth data voltage VS3 and the fifth data voltage VS0' may have the same magnitude but different polarities.

Also, the magnitude of the fourth data voltage VS3 can be greater than the magnitude of the first data voltage VS0, the magnitude of the first data voltage VS0 can be greater than the magnitude of the third data voltage VS2, and the magnitude of the third data voltage VS2 can be greater than the magnitude of the second data voltage VS1. Furthermore, the fourth data voltage VS3 and the third data voltage VS2 can have the same polarity, the third data voltage VS2 and the second data voltage VS1 can have different polarities, and the second data voltage VS1 and the first data voltage VS0 can have the same polarity.

For example, but it is not limited thereto, the first data voltage VS0 can be −2V, the second data voltage VS1 can be −0.2V, the third data voltage VS2 can be 1.4V, and the fourth data voltage VS3 can be 3V. Correspondingly, the fifth data voltage VS0' can be −3V, the sixth data voltage VS1' can be −1.4V, the seventh data voltage VS2' can be 0.2V, and the eighth data voltage VS3' can be 2V In this case, the common voltage line CGm can remain at the reference voltage V0, such as 0V. The image data "00" may be correspond to the second data voltage VS1 and the seventh data voltage VS2', the image data "01" may be correspond to the third data voltage VS2 and the sixth data voltage VS1', the image data "10" may be correspond to the first data voltage VS0 and the eighth data voltage VS3', and the image data "11" may be correspond to the fourth data voltage VS3 and the fifth data voltage VS0'. By alternating the polarities of the data voltage, the voltage margin between the data voltages of the same polarity can be widen.

Figure 5:
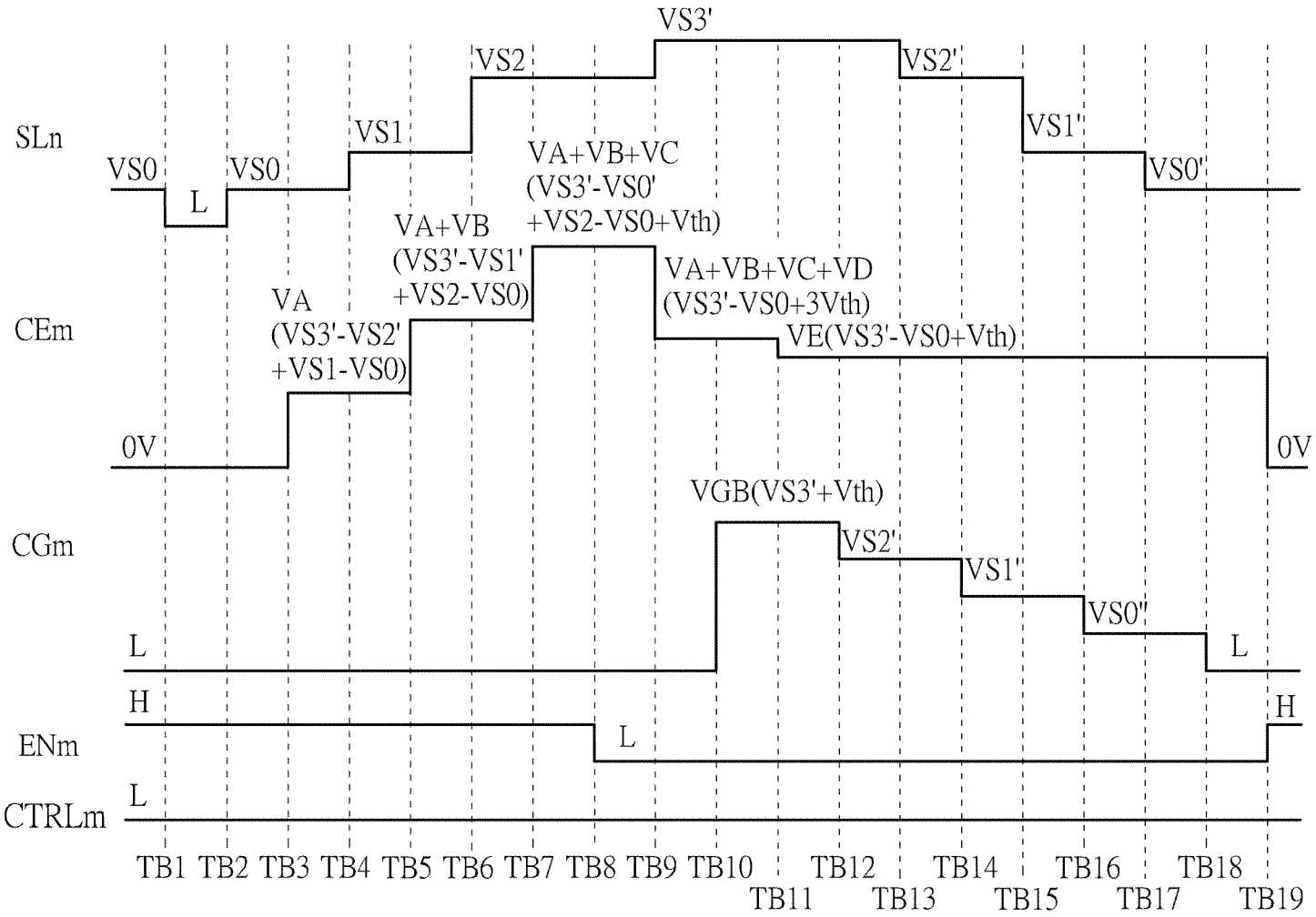
FIG. 5 shows a timing diagram of the signals received by the pixel circuit in FIG. 2 during the refreshing processes according to another embodiment.
Figure 6:
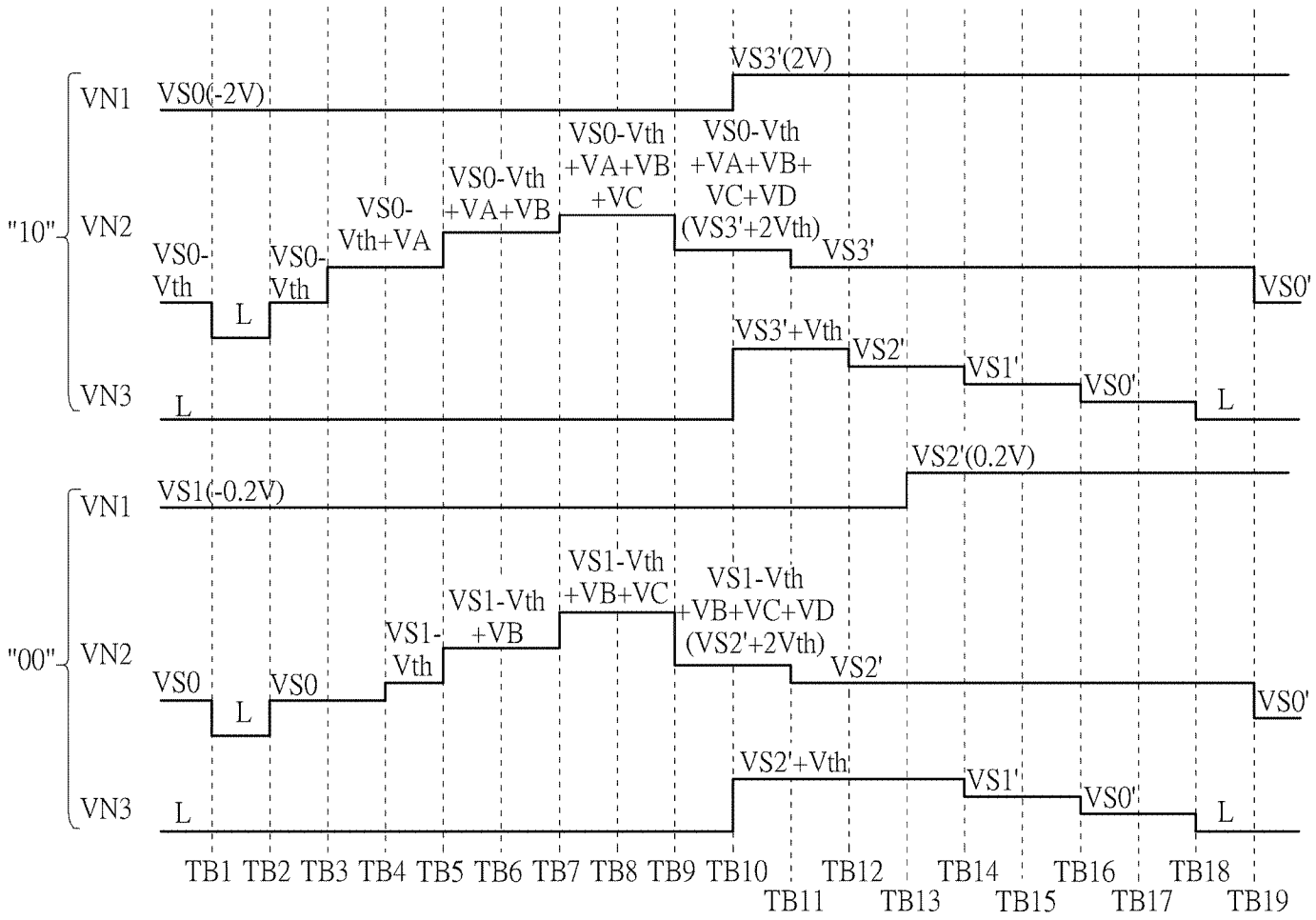
FIGS. 6 and 7 show the voltages of the first capacitor and the second capacitor with the image data being "11", "10", "01", and "00" according to the waveform shown in FIG. 5.
Figure 7:
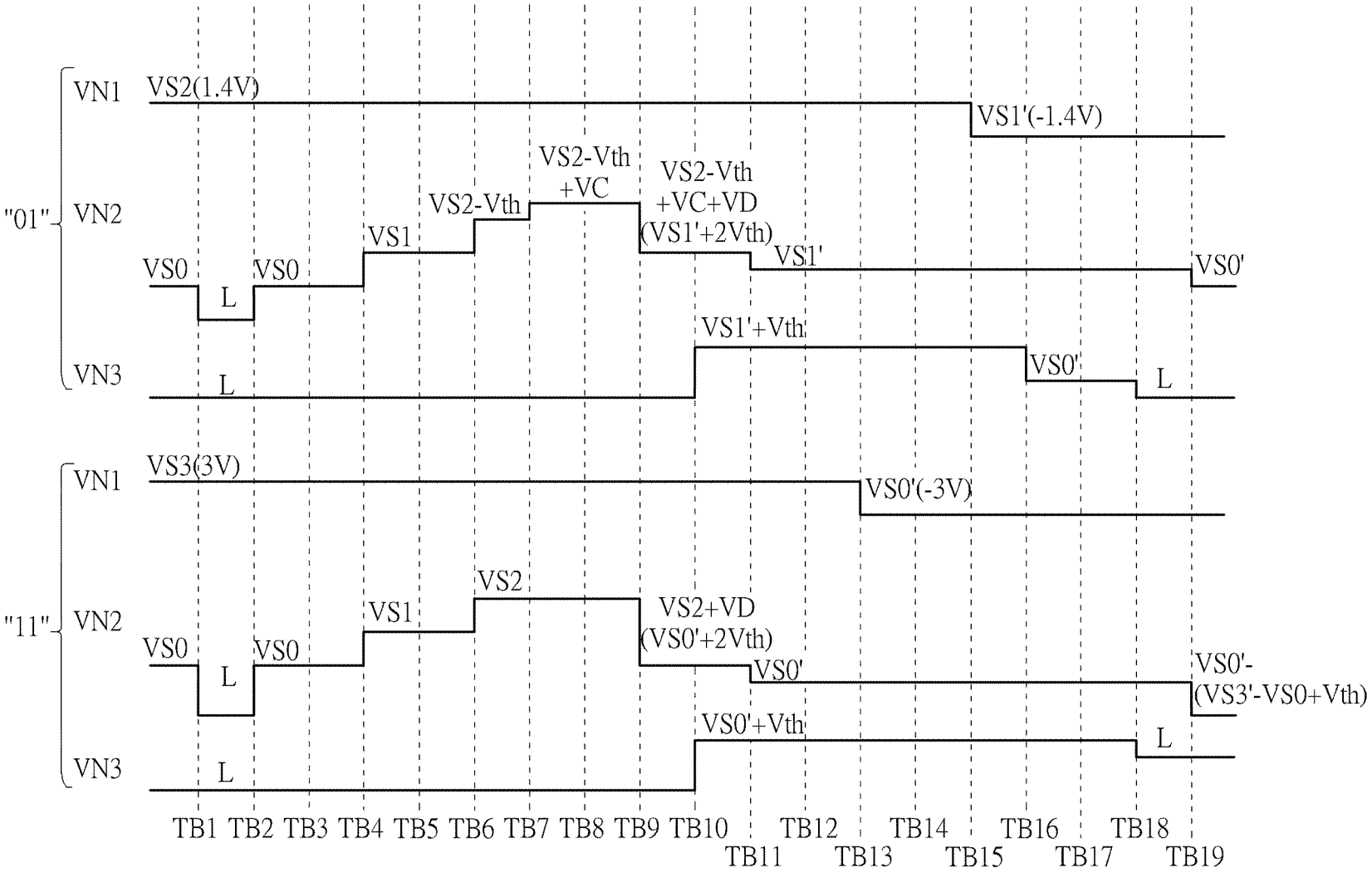

FIG. 5 shows a timing diagram of the signals received by the pixel circuit 100(*m,n*) during the a refreshing processes with the polarities of the data voltages being alternated. FIGS. 6 and 7 show the voltages VN1 of the second terminal of the first capacitor C1A, the voltages VN2 of the second terminal of the second capacitor C2A, and the voltage VN3 of the control terminal of the first transistor M1A with the image data stored in the pixel circuit 100(*m,n*) being "11", "10", "01", and "00" according to the waveform shown in FIG. 5.

In FIG. 5, before the refreshing process starts at time TB1, the pixel circuit 100(*m,n*) has been written with the desired image data "11", "10", "01", or "00"; therefore, the voltage VN1 of the second terminal of the first capacitor C1A is at the data voltage VS0, VS1, VS2, or VS3 according to the image data stored. Also, before the refreshing process starts, the pixel circuit 100(*m,n*) can be at the suspend mode. When the pixel circuit 100 (*m,n*) is at the suspend mode, the first transistor M1A is turned off. In this case, the voltage of the source line SLn can be, for example, at the first data voltage VS0 (or other data voltages according to the previous operations), the voltage of the gate line CGm can be at the low voltage L, the voltage of the first control line CEm can be at the reference voltage V0, the voltage of the second control line ENm can be at the high voltage H, and the voltage of the third control line CTRLm can be at the low voltage L.

During the refreshing process as shown in FIG. 5, the third control line CTRLm remains at the low voltage L, so the third capacitor C3A can be used to preserve the voltage VN3 of the control terminal of the first transistor M1A when the third transistor M3A is turned off.

At time TB1, the voltage of the source line SLn is changed to the low voltage L. Since the low voltage L is even lower than the lowest data voltage, the second transistor M2A and the fourth transistor M4A can all be turned on. Therefore, the voltage VN2 of the second terminal of the second capacitor C2A is at the low voltage L, and the third transistor M3A is turned off.

At time TB2, the voltage of the source line SLn is changed from the low voltage L to the first data voltage VS0. In this case, the fourth transistor M4A remains turned on. If the pixel circuit 100 (*m, n*) stores the image data "11", "01", or "00", then the second transistor M2A can be turned on, so the voltage VN2 of the second terminal of the second capacitor C2A would be the first data voltage VS0 as the source line SLn.

However, if the pixel circuit 100 (*m, n*) stores the image data "10", then the second transistor M2A will be finally turned off when the voltage VN2 of the second terminal of the second capacitor C2A reaches to a voltage lower than the first data voltage by a threshold voltage Vth of the second transistor M2A, that is, (VS0−Vth), as shown in FIG. 6.

At time TB3, the voltage of the first control line CEm is changed from the reference voltage V0 to a first intermediate voltage VA. The reference voltage V0 can be the system ground voltage, for example, in the present embodiment, the reference voltage V0 can be 0V. The first intermediate voltage VA can be substantially equal to the eighth data voltage VS3' minus the seventh data voltage VS2' plus the second data voltage VS1 and minus the first data voltage VS0, that is, (VS3'−VS2'+VS1−VS0). In this case, if the pixel circuit 100 (*m, n*) stores the image data "11", "01", or "00", then the second transistor M2A remains turned on, so the voltage VN2 of the second terminal of the second capacitor C2A would be the first data voltage VS0. However, if the pixel circuit 100 (*m,n*) stores the image data "10", then the second transistor M2A is turned off. Since there no discharging/charging path for the second terminal of the second capacitor C2A, the voltage VN2 of the second terminal of the second capacitor C2A would be raised to (VS0−Vth+VA) as the voltage of the first control line CEm changes.

At time TB4, the voltage of the source line SLn is changed from the first data voltage VS0 to the second data voltage VS1. In this case, if the pixel circuit 100 (*m, n*) stores the image data "01", "11", then the second transistor M2A and the fourth transistor M4A would still turned on, making the voltage VN2 of the second terminal of the second capacitor C2A at the second data voltage VS1. However, if the pixel circuit 100(*m,n*) stores the image data "00", then the second transistor M2A will finally turned off when the voltage VN2 of the second terminal of the second capacitor C2A reaches to (VS1−Vth). Also, if the pixel circuit 100 (*m, n*) stores the image data "10", then the second transistor M2A would remain turned off, so the voltage VN2 of the second terminal of the second capacitor C2A would be unchanged at (VS0−Vth+VA).

At time TB5, the voltage of the first control line CEm is changed from the first intermediate voltage VA to a second intermediate voltage (VA+VB). In some embodiments, the second intermediate voltage (VA+VB) can be substantially equal to the eighth data voltage VS3' minus the sixth data voltage VS1' plus the third data voltage VS2 and minus the first data voltage VS0, that is (VS3'−VS1'+VS2−VS0), and the voltage VB can be (VS2'+VS2−VS1−VS1').

In this case, if the pixel circuit 100(*m,n*) stores the image data "01", "11", then the second transistor M2A and the fourth transistor M4A would still turned on, and the voltage VN2 of the second terminal of the second capacitor C2A would still be the second data voltage VS1. If the pixel circuit 100 (*m, n*) stores the image data "00" or "10", then the second transistor M2A would remain turned off, and the voltage VN2 of the second terminal of the second capacitor C2A would be changed by the voltage VB according to the voltage change of the first control line CEm as shown in FIG. 6.

At time TB6, the voltage of the source line SLn is changed from the second data voltage VS1 to the third data voltage VS2. In this case, if the pixel circuit 100 (*m, n*) stores the image data "11", then the second transistor M2A and the fourth transistor M4A would still turned on, making the voltage VN2 of the second terminal of the second capacitor C2A at the third data voltage VS2. However, if the pixel circuit 100 (*m, n*) stores the image data "01", then the second transistor M2A will finally turned off when the voltage VN2 of the second terminal of the second capacitor C2A reaches to (VS2−Vth). Also, if the pixel circuit 100 (*m, n*) stores the image data "00" or "10", then the second transistor M2A would remain turned off, so the voltage VN2 of the second terminal of the second capacitor C2A would be unchanged as shown in FIG. 6.

At time TB7, the voltage of the first control line CEm is changed from the second intermediate voltage (VA+VB) to a third intermediate voltage (VA+VB+VC). In some embodiments, the third intermediate voltage (VA+VB+VC) can be substantially equal to the eighth data voltage VS3' minus the fifth data voltage VS0' plus the third data voltage VS2 minus the first data voltage VS0, and plus a threshold voltage of the first transistor M1A. In some embodiments, the transistors of the pixel circuit 100(*m,n*) can substantially have the same threshold voltage; therefore, the third intermediate voltage (VA+VB+VC) can be represented as (VS3'−VS0'+VS2−VS0+Vth), and the voltage VC can be (VS1'−VS0'+Vth).

In this case, if the pixel circuit 100(*m,n*) stores the image data "11", then the second transistor M2A and the fourth transistor M4A would still be turned on, and the voltage VN2 of the second terminal of the second capacitor C2A would still be the third data voltage VS2. If the pixel circuit 100(*m,n*) stores the image data "10", "00" or "01", then the second transistor M2A would remain turned off, and the voltage VN2 of the second terminal of the second capacitor C2A would be changed by the voltage VC according to the voltage change of the first control line CEm as shown in FIGS. 6 and 7.

At time TB8, the voltage of the second control line ENm is changed from the high voltage H to the low voltage L. Since the low voltage L is lower than the lowest data voltage, the fourth transistor M4A is turned off at time TB8.

At time TB9, the voltage of the source line SLn is changed from the third data voltage VS2 to the eighth data voltage VS3', and the voltage of the first control line CEm is changed from the third intermediate voltage (VA+VB+VC) to a fourth intermediate voltage (VA+VB+VC+VD). In some embodiment, the fourth intermediate voltage (VA+VB+VC+VD) can be substantially equal to the eighth data voltage VS3' minus the first data voltage VS0 and plus three times the threshold voltage Vth, that is, (VS3'−VS0+3Vth), and the voltage VD can be (VS0'−VS2+2Vth).

In this case, since the fourth transistor M4A remains turned off, the voltage VN2 of the second terminal of the second capacitor C2A would be changed by the voltage VD (the voltage VD is negative in the present embodiment) according to the voltage change of the first control line CEm as shown in FIGS. 6 and 7.

At time TB10, the voltage of the gate line CGm is changed from the low voltage L to a push voltage VGB. The push voltage VGB can be substantially equal to the eighth data voltage VS3' plus the threshold voltage Vth, that is, (VS3'+Vth). In this case, if the pixel circuit 100(*m,n*) stores the image data "11", "01" or "00", then the third transistor M3A will finally be turned off when the voltage VN3 of the control terminal of the first transistor M1A reaches to a voltage lower than the voltage VN2 of the second terminal of the second capacitor C2A by one threshold voltage Vth. However, if the pixel circuit 100(*m,n*) stores the image data "10", then the high voltage VN2 would be higher than the push voltage VGB by on threshold voltage Vth, and the third transistor M3A would remain turned on. Therefore, the voltage VN3 of the control terminal of the first transistor M1A would be at the push voltage VGB as the gate line CGm, turning on the first transistor M1A. Therefore, the second terminal of the first capacitor C1A would receive the eighth data voltage VS3', and the pixel circuit 100(*m,n*) storing the image data "10" can be refreshed with the polarity being alternated.

At time TB11, the voltage of the first control line CEm is changed from the fourth intermediate voltage (VA+VB+VC+VD) to a fifth intermediate voltage VE. The fifth intermediate voltage VE can be substantially equal to the eighth data voltage VS3' minus the first data voltage VS0 and plus the threshold voltage Vth, that is, (VS3'−VS0+Vth), which is lower than the fourth intermediate voltage (VA+VB+VC+VD) by two times the threshold voltage Vth. In this case, since the fourth transistor M4A remains turned off, the voltage VN2 of the second terminal of the second capacitor C2A would be dropped by 2Vth as the voltage change of the first control line CEm. Therefore, the third transistor M3A would be turned off.

At time TB12, the voltage of the gate line CGm is changed from the push voltage VGB to the seventh data voltage VS2'. In this case, if the pixel circuit 100(*m,n*) stores the image data "10", then the third transistor M3A would be turned on since the voltage VN2 of the second terminal of the second capacitor C2A is at the eighth data voltage VS3' higher than the seventh data voltage VS2'. The control terminal of the first transistor M1A would receive the seventh data voltage VS2' through the third transistor M3A, and the first transistor M1A would be turned off.

However, if the pixel circuit 100(*m,n*) stores the image data "00", "01", "11", then the first transistor M1A and the third transistor M3A will still be turned off.

At time TB13, the voltage of the source line SLn is changed from the eighth data voltage VS3' to the seventh data voltage VS2'. In this case, if the pixel circuit 100(*m,n*) stores the image data "00", then the first transistor M1A will be turned on since the voltage VN3 of the control terminal of the first transistor M1A is higher than the seventh data voltage VS2' by the threshold voltage Vth. Therefore, the second terminal of the first capacitor C1A would receive the seventh data voltage VS2', and the pixel circuit 100 (*m, n*) storing the image data "00" can be refreshed with the polarity being alternated.

However, if the pixel circuit 100 (*m, n*) stores the image data "10", "01" or "11", then the first transistor MIA would remain turned off, so the pixel circuit 100 (*m,n*) storing the image data "10", "01" or "11" would not be refreshed.

At time TB14, the voltage of the gate line CGm is changed from the seventh data voltage VS2' to the sixth data voltage VS1'. In this case, if the pixel circuit 100 (*m,n*) stores the image data "10" or "00", then the third transistor M3A would remain turned on since the voltage VN2 of the second terminal of the second capacitor C2A is at the eighth data voltage VS3' or the seventh data voltage VS2' as shown in FIG. 6 and either one is the higher than the sixth data voltage VS1'. The control terminal of the first transistor M1A would receive the sixth data voltage VS1' through the third transistor M3A, and the first transistor M1A would be turned off.

However, if the pixel circuit 100(*m,n*) stores the image data "01", "11", then the first transistor M1A and the third transistor M3A will still be turned off.

At time TB15, the voltage of the source line SLn is changed from the seventh data voltage VS2' to the sixth data voltage VS1'. In this case, if the pixel circuit 100(*m,n*) stores the image data "01", then the first transistor M1A will be turned on since the voltage VN3 of the control terminal of the first transistor M1A is higher than the sixth data voltage VS1' by the threshold voltage Vth. Therefore, the second terminal of the first capacitor C1A would receive the sixth data voltage VS1', and the pixel circuit 100(*m,n*) storing the image data "01" can be refreshed with the polarity being alternated.

However, if the pixel circuit 100(*m,n*) stores the image data "10", "00" or "11", then the first transistor M1A would remain turned off, so the pixel circuit 100(*m,n*) storing the image data "10", "00" or "11" would not be refreshed.

At time TB16, the voltage of the gate line CGm is changed from the sixth data voltage VS1' to the fifth data voltage VS0'. In this case, if the pixel circuit 100(*m,n*) stores the image data "10", "00", or "01", then the third transistor M3A would be turned on since the voltage VN2 of the second terminal of the second capacitor C2A is higher than the sixth data voltage VS1' as shown in FIGS. 6 and 7. The control terminal of the first transistor M1A would receive the fifth data voltage VS0' through the third transistor M3A, and the first transistor M1A would be turned off.

However, if the pixel circuit 100(*m,n*) stores the image data "11", then the first transistor M1A and the third transistor M3A will still be turned off.

At time TB17, the voltage of the source line SLn is changed from the sixth data voltage VS1' to the fifth data voltage VS0'. In this case, if the pixel circuit 100(*m,n*) stores the image data "11", then the first transistor M1A will be turned on since the voltage VN3 of the control terminal of the first transistor M1A is higher than the fifth data voltage VS0' by the threshold voltage Vth. Therefore, the second terminal of the first capacitor C1A would receive the fifth data voltage VS0', and the pixel circuit 100(*m,n*) storing the image data "11" can be refreshed with the polarity being alternated.

However, if the pixel circuit 100(*m,n*) stores the image data "10", "00" or "01", then the first transistor M1A would remain turned off, so the pixel circuit 100(*m,n*) storing the image data "10", "00" or "11" would not be refreshed.

At time TB18, the voltage of the gate line CGm is changed from the fifth data voltage VS0' to the low voltage L. In this case, the third transistor M3A would be turned on, and the control terminal of the first transistor M1A would receive the low voltage L from the gate line CGm through the third transistor M3A. Therefore, the first transistor M1A can be turned off.

At time TB19, the voltage of the first control line CEm is changed from the fifth intermediate voltage VE to the reference voltage V0, and the voltage of the second control line ENm is changed from the low voltage L to the high voltage H. Therefore, the pixel circuit 100(*m,n*) enters the suspend mode again.

By controlling the voltages of the signal lines with the waveforms shown in FIG. 5, the pixel circuit 100 (*m,n*) can be refreshed with the polarity being alternated. Also, since the voltage of the first capacitor C1A is sampled by the control terminal of the control terminal of the second transistor M2A, the charges stored in the first capacitor C1A can hardly dissipate during the refreshing process.

Also, although the refreshing process shown in FIGS. 5, 6 and 7 can alternate the data voltages VS0, VS1, VS2, and VS3 to VS3', VS2', VS1', and VS0' respectively, however, the same process can be applied when alternating the data voltages VS0', VS1', VS2', and VS3' to VS3, VS2, VS1, and VS0 respectively.

In some embodiment, the pixel circuits 100(1,1) to 100 (M,N) can be all in the first polarity mode in the same period or all in the second polarity mode in the same period. That is, the pixel circuits 100(1,1) to 100(M,N) can be controlled with the same refreshing process. However, in some other embodiments, the pixel circuits 100(1,1) to 100(M,N) may be in two different polarity modes in the same time. For example, pixel circuits disposed in even columns may be in the first polarity mode while pixel circuits disposed in odd columns may be in the second polarity mode. For example, but it is not limited thereto, pixel circuits in two adjacent columns may be in two polarity modes. In this case, the refreshing process can still be applied at the same time, however, the data voltages applied to the source lines for the two adjacent columns would be different.

Figure 8:
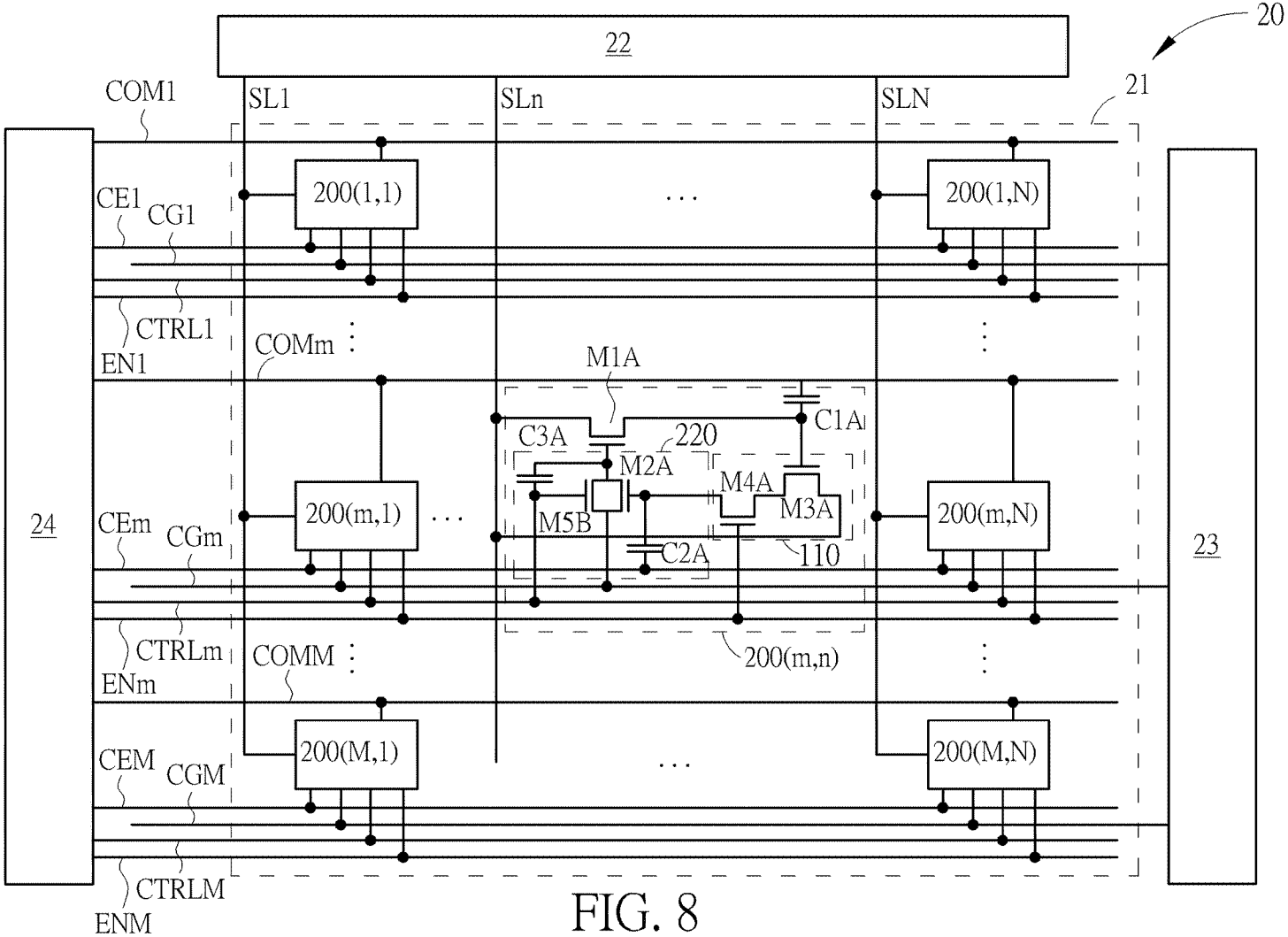
FIG. 8 shows a display device according to another embodiment of the present disclosure.

FIG. 8 shows a display device 20 according to one embodiment of the present disclosure. The display device 20 has similar structure as the display device 10. However, the display device 20 includes an pixel array 21, a source driver 22, a gate driver 23, and a control driver 24. In some embodiments, the gate driver 23 and the control driver 24 are integrated, but that is not limited thereto. In some embodiments, the source driver 22, the gate driver 23 and the control driver 24 may be integrated.

The pixel array 21 includes N source lines SL1 to SLN, M common voltage lines COM1 to COMM, M gate lines CG1 to CGM, M first control lines CE1 to CEM, M second control lines EN1 to ENM, M third control lines CTRL1 to CTRLM, and M×N pixel circuits 200(1,1) to 200(M,N) arranged in a matrix.

Each of pixel circuits 200(1,1) to 200(M,N) is coupled to a corresponding source line, a corresponding common voltage line, a corresponding gate line, a corresponding first control line, a corresponding second control line, and a corresponding third control line.

As taken for an example, FIG. 8 further shows the structure of the pixel circuit 200(*m,n*), which has a similar structure as the pixel circuits 100(*m,n*). However, the memory circuit 220 of the pixel circuit 200(*m,n*) further includes a fifth transistor M5B.

The fifth transistor M5B has a first terminal, a second terminal, and a control terminal. The first terminal of the fifth transistor M5B is coupled to the control terminal of the first transistor M1A, the second terminal of the fifth transistor M5B is coupled to the gate line GLm, and the control terminal of the fifth transistor M5B is coupled to the first terminal of the third capacitor C3A.

The third capacitor C3A and the fifth transistor M5B can help to initialize the pixel circuit 200(*m,n*) and write the image data to the pixel circuit 200(*m,n*).

Figure 9:
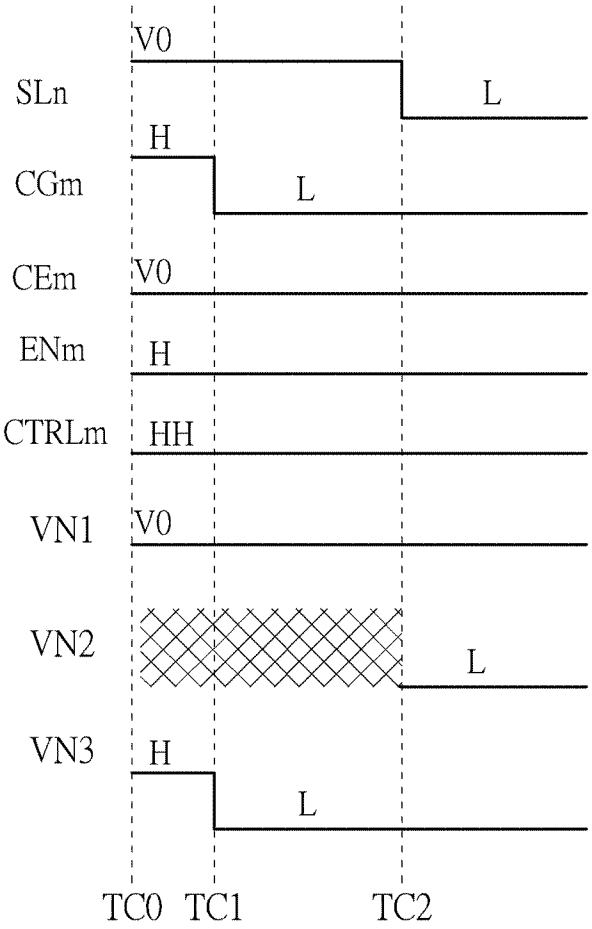
FIG. 9 shows the voltages received by the pixel circuit in FIG. 8 during the initialization process.

FIG. 9 shows the voltage received by the pixel circuit 200 (*m, n*) during the initialization process.

In FIG. 9, in the beginning time TC0 of the initialization process of the pixel circuit 200(*m,n*), the voltage of the source line SLn is at the reference voltage V0, the voltage of the gate line CGm is at the first high voltage H, the voltage of the first control line CEm is at the reference voltage V0, the voltage of the second control line ENm is at the first high voltage H, and the voltage of the third control line CTRLm is at the second high voltage HH.

In the present embodiment, the second high voltage HH is higher than the first high voltage H. Therefore, the fifth transistor M5B is turned on, so the control terminal of the first transistor MIA would receive the first high voltage from the gate line CGm through the fifth transistor M5B. Therefore, the first transistor M1A is turned on and the voltage VN1 of the second terminal of the first capacitor C1A would be at the reference voltage V0, turning off the second transistor M2A. The voltage VN2 of the second terminal of the second capacitor C2A may be at an unspecified voltage according to previous status.

At time TC1, the voltage of the gate line CGm is changed from the first high voltage H to the low voltage L. In this case, the voltage VN3 of the control terminal of the first transistor M1A would change to the low voltage, and the first transistor M1A would be turned off.

At time TC2, the voltage of the source line SLn is changed from the reference voltage V0 to the low voltage L. Since the low voltage L is lower than the reference voltage V0, the second transistor M2A would be turned on, and the fourth transistor M4A is also turned on. Therefore, the voltage VN2 of the second terminal of the second capacitor C2A would be set to the low voltage L. Therefore, the pixel circuit 200(*m,n*) will enter the suspend mode, and is ready for the following process, such as the write process or the refreshing process.

Figure 10:
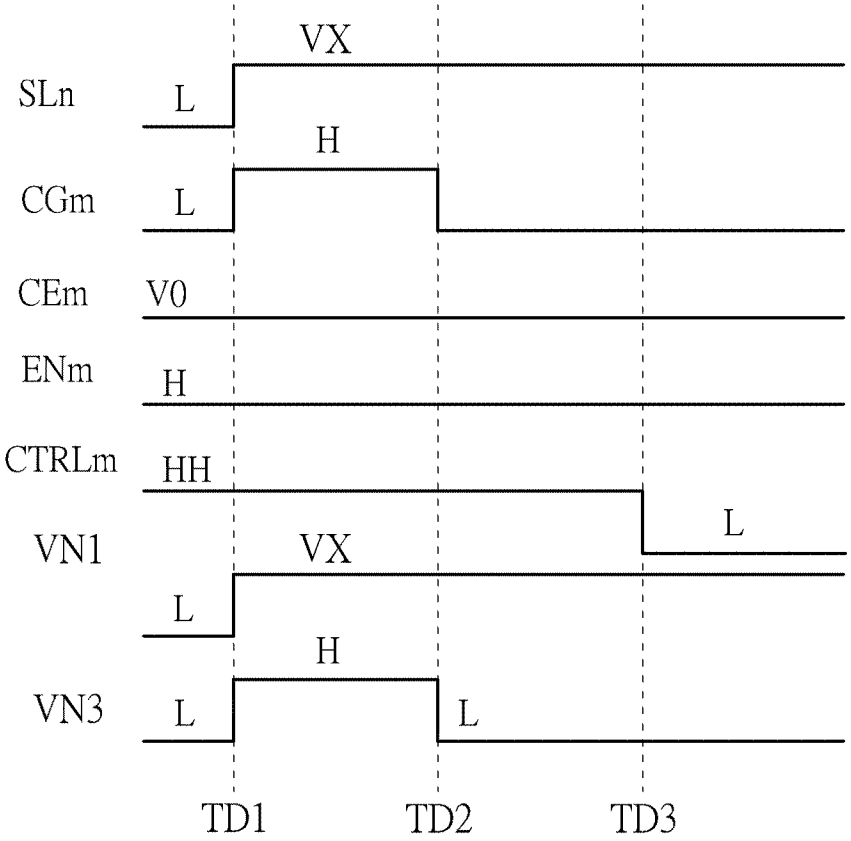
FIG. 10 shows the voltages received by the pixel circuit in FIG. 8 during the write process.

FIG. 10 shows the voltage received by the pixel circuit 200 (*m, n*) during the write process.

In FIG. 10, before the write process, the pixel circuit 200 (*m, n*) has been initialized and is in the suspend mode. At time TD1, the voltage of the source line SLn is changed to a data voltage VX corresponding to pixel data to be shown, the voltage of gate line CGm is at the first high voltage H, the voltage of the first control line CEm is at the reference voltage V0, the voltage of the second control line ENm is at the first high voltage H, and the voltage of the third control line CTRLm is at the second high voltage HH.

In this case, the fifth transistor M5B is turned on, so the control terminal of the first transistor M1A would receive the first high voltage H, turning on the first transistor M1A. Therefore, the second terminal of the first capacitor C1A would receive the data voltage VX corresponding to pixel data to be shown. For example, the data voltage VX may be one of the data voltage VS0, VS1, VS2 or VS3. Therefore, the pixel circuit 200(*m,n*) can be written.

At time TD2, the voltage of the gate line CGm is changed from the first high voltage H to the low voltage L. Since the fifth transistor M5B is still turned on, the control terminal of the first transistor M1A would receive the low voltage L, turning off the first transistor M1A, and the pixel circuit 200(*m,n*) is closed and stops being written.

At time TD3, the voltage of the third control line CTRLm is changed from the second high voltage HH to the low voltage L, turning off the first transistor M1A and the fifth transistor M5B.

With the third capacitor C3A and the fifth transistor M5A, the initialization and write process of the pixel circuit 200(*m,n*) can be simplified. In some embodiments, the pixel circuits 200(1,1) to 200 (M,N) can all be initialized with the same manner as shown in FIG. 8 simultaneously, and can be written with the same manner as shown in FIG. 10 one row at a time.

In summary, the display devices and the pixel circuits provided by the embodiments of the present disclosure can store the image data and perform the refreshing processes with a small area. Also, since the data voltage stored in the capacitor can be sampled by the control terminal of the transistor, the charges dissipating from the capacitor during the refreshing processes will be reduced, reducing flickers. Furthermore, the proposed display devices and the pixel circuits are compatible with data voltages of alternating polarities, allowing wider voltage margin.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A display device comprising:

a display panel comprising:

a source line;

a common voltage line;

a first control line;

a second control line;

a third control line;

a gate line; and a pixel circuit comprising:

a first capacitor having a first terminal and a second terminal, wherein the first terminal of the first capacitor is coupled to the common voltage line;

a first transistor having a first terminal, a second terminal and a control terminal, wherein the first terminal of the first transistor is coupled to the source line, and the second terminal of the first transistor is coupled to the second terminal of the first capacitor;

a sample circuit comprising:

a second transistor having a first terminal, a second terminal and a control terminal, wherein the first terminal of the second transistor is coupled to the source line, and the control terminal of the second transistor is coupled to the second terminal of the first capacitor; and a fourth transistor having a first terminal, a second terminal and a control terminal, wherein the second terminal of the fourth transistor is coupled to the second terminal of the second transistor, and the control terminal of the fourth transistor is coupled to the second control line; and a memory circuit comprising:

a second capacitor having a first terminal and a second terminal, wherein the first terminal of the second capacitor is coupled to the first control line;

a third transistor having a first terminal, a second terminal and a control terminal, wherein the first terminal of the third transistor is coupled to the control terminal of the first transistor, the second terminal of the third transistor is coupled to the gate line, and the control terminal of the third transistor is coupled to the second terminal of the second capacitor and the first terminal of the fourth transistor; and a third capacitor having a first terminal and a second terminal, wherein the first terminal of the third capacitor is coupled to the third control line, and the second terminal of the third capacitor is coupled to the control terminal of the first transistor.

2. The display device of claim 1, wherein the memory circuit further comprises:

a fifth transistor having a first terminal, a second terminal and a control terminal, wherein the first terminal of the fifth transistor is coupled to the control terminal of the first transistor, the second terminal of the fifth transistor is coupled to the gate line, and the control terminal of the fifth transistor is coupled to the first terminal of the third capacitor.

3. The display device of claim 2, wherein:

during an initialization process of the display device:

at a first time point, a voltage of the source line is set to be a reference voltage, a voltage of the gate line is set to be a first high voltage, a voltage of the first control line is set to be the reference voltage, a voltage of the second control line is set to be the first high voltage, and a voltage of the third control line is set to be at a second high voltage;

at a second time, the voltage of the gate line is changed from the first high voltage to the low voltage; and at a third time, the voltage of the source line is changed from the reference voltage to the low voltage;

the second high voltage is higher than the first high voltage, the first high voltage is higher than the reference voltage, and the reference voltage is higher than the low voltage.

4. The display device of claim 1, wherein:

when the pixel circuit is in a first polarity mode:

a voltage between the first terminal of the first capacitor and the second the second terminal of the first capacitor is set to be a first data voltage, a second data voltage, a third data voltage, or a fourth data voltage according to pixel data to show;

when the pixel circuit is in a second polarity mode:

the voltage between the first terminal of the first capacitor and the second terminal of the first capacitor is set to be a fifth data voltage, a sixth data voltage, a seventh data voltage, or an eighth data voltage according to pixel data to be show;

the first data voltage and the eighth data voltage substantially have a same magnitude but different polarities;

the second data voltage and the seventh data voltage substantially have a same magnitude but different polarities;

the third data voltage and the sixth data voltage substantially have a same magnitude but different polarities;

the fourth data voltage and the fifth data voltage substantially have a same magnitude but different polarities;

a magnitude of the fourth data voltage is greater than a magnitude of the first data voltage;

the magnitude of the first data voltage is greater than a magnitude of the third data voltage;

the magnitude of the third data voltage is greater than a magnitude of the second data voltage;

the fourth data voltage and the third data voltage have a same polarity;

the third data voltage and the second data voltage have different polarities; and the second data voltage and the first data voltage have a same polarity.

5. The display device of claim 4, wherein:

during the first polarity mode of the display device:

at a first time, a voltage of the source line is changed to a low voltage;

at a second time, the voltage of the source line is changed from the low voltage to the first data voltage;

at a third time, a voltage of the first control line is changed from a reference voltage to a first intermediate voltage;

at a fourth time, the voltage of the source line is changed from the first data voltage to the second data voltage;

at a fifth time, the voltage of the first control line is changed from the first intermediate voltage to a second intermediate voltage;

at a sixth time, the voltage of the source line is changed from the second data voltage to the third data voltage;

at a seventh time, the voltage of the first control line is changed from the second intermediate voltage to a third intermediate voltage; and at an eighth time, a voltage of the second control line is changed from a high voltage to the low voltage;

the low voltage is lower than the first to eighth data voltages;

the high voltage is higher than the first to eighth data voltages;

the first intermediate voltage is substantially equal to the eighth data voltage minus the seventh data voltage plus the second data voltage and minus the first data voltage;

the second intermediate voltage is substantially equal to the eighth data voltage minus the sixth data voltage plus the third data voltage and minus the first data voltage; and the third intermediate voltage is substantially equal to the eighth data voltage minus the fifth data voltage plus the third data voltage minus the first data voltage, and plus a threshold voltage of the first transistor.

6. The display device of claim 4, wherein:

during the second polarity mode of the display device:

at a first time, the voltage of the source line is changed from the third data voltage to the eighth data voltage, and the voltage of the first control line is changed from the third intermediate voltage to a fourth intermediate voltage;

at a second time, a voltage of the gate line is changed from the low voltage to a push voltage;

at a third time, the voltage of the first control line is changed from the fourth intermediate voltage to a fifth intermediate voltage;

at a fourth point, the voltage of the gate line is changed from the push voltage to the seventh data voltage;

at a fifth time, the voltage of the source line is changed from the eighth data voltage to the seventh data voltage;

at a sixth time, the voltage of the gate line is changed from the seventh data voltage to the sixth data voltage;

at a seventh time, the voltage of the source line is changed from the seventh data voltage to the sixth data voltage;

at an eighth time, the voltage of the gate line is changed from the sixth data voltage to the fifth data voltage;

at a ninth time, the voltage of the source line is changed from the sixth data voltage to the fifth data voltage;

at a tenth time, the voltage of the gate line is changed from the fifth data voltage to the low voltage; and at an eleventh time, the voltage of the first control line is changed from the fifth intermediate voltage to the reference voltage, and the voltage of the second control line is changed from the low voltage to the high voltage;

the fourth intermediate voltage is substantially equal to the eighth data voltage minus the first data voltage, and plus three times the threshold voltage;

the fifth intermediate voltage is substantially equal to the eighth data voltage minus the first data voltage, and plus the threshold voltage; and the push voltage is substantially equal to the eighth data voltage plus the threshold voltage.

7. The display device of claim 1, wherein:

a voltage between the first terminal of the first capacitor and the second terminal of the first capacitor is set to be a first data voltage, a second data voltage, a third data voltage, or a fourth data voltage according to pixel data to be shown; and the fourth data voltage is greater than the third data voltage, the third data voltage is greater than the second data voltage, and the second data voltage is greater than the first data voltage.

8. The display device of claim 7, wherein:

during a refreshing process of the display device:

at a first time, a voltage of the source line is changed to a low voltage;

at a second time, the voltage of the source line is changed from the low voltage to the fourth data voltage;

at a third time, a voltage of the second control line is changed from a high voltage to the low voltage;

at a fourth time, a voltage of the first control line is changed from a reference voltage to a first intermediate voltage;

at a fifth time, a voltage of the gate line is changed from the low voltage to a push voltage;

at a sixth time, the voltage of the first control line is changed from the first intermediate voltage to a second intermediate voltage;

at a seventh time, the voltage of the gate line is changed from the push voltage to the third data voltage;

at an eighth time, the voltage of the source line is changed from the fourth data voltage to the third data voltage;

at a ninth time, the voltage of the gate line is changed from the third data voltage to the second data voltage;

at a tenth time, the voltage of the source line is changed from the third data voltage to the second data voltage;

at an eleventh time, the voltage of the gate line is changed from the second data voltage to the first data voltage;

at a twelfth time, the voltage of the source line is changed from the second data voltage to the first data voltage;

at a thirteenth time, the voltage of the gate line is changed from the first data voltage to the low voltage; and at a fourteenth time, the voltage of the first control line is changed from the second intermediate voltage to the reference voltage, and the voltage of the second control line is changed from the low voltage to the high voltage;

the low voltage is lower than the first to fourth data voltages;

the high voltage is higher than the first to fourth data voltages;

the first intermediate voltage is substantially equal to three times a threshold voltage of the first transistor;

the second intermediate voltage is substantially equal to the threshold voltage; and the push voltage is substantially equal to the fourth data voltage plus the threshold voltage.

9. A display panel comprising:

a source line;

a common voltage line;

a first control line;

a second control line;

a third control line;

a gate line; and a pixel circuit comprising:

a first capacitor having a first terminal and a second terminal, wherein the first terminal of the first capacitor is coupled to the common voltage line;

a first transistor having a first terminal, a second terminal and a control terminal, wherein the first terminal of the first transistor is coupled to the source line, and the second terminal of the first transistor is coupled to the second terminal of the first capacitor;

a sample circuit coupled to the second terminal of the first capacitor and comprising:

a second transistor having a first terminal, a second terminal and a control terminal, wherein the first terminal of the second transistor is coupled to the source line, and the control terminal of the second transistor is coupled to the second terminal of the first capacitor; and a fourth transistor having a first terminal, a second terminal and a control terminal, wherein the second terminal of the fourth transistor is coupled to the second terminal of the second transistor, and the control terminal of the fourth transistor is coupled to the second control line; and a memory circuit comprising:

a second capacitor having a first terminal and a second terminal, wherein the first terminal of the second capacitor is coupled to the first control line;

a third transistor having a first terminal, a second terminal and a control terminal, wherein the first terminal of the third transistor is coupled to the control terminal of the first transistor, the second terminal of the third transistor is coupled to the gate line, and the control terminal of the third transistor is coupled to the second terminal of the second capacitor and the first terminal of the fourth transistor; and a third capacitor having a first terminal and a second terminal, wherein the first terminal of the third capacitor is coupled to the third control line, and the second terminal of the third capacitor is coupled to the control terminal of the first transistor.

10. The display panel of claim 9, wherein the memory circuit further comprises:

a fifth transistor having a first terminal, a second terminal and a control terminal, wherein the first terminal of the fifth transistor is coupled to the control terminal of the first transistor, the second terminal of the fifth transistor is coupled to the gate line, and the control terminal of the fifth transistor is coupled to the first terminal of the third capacitor.

11. The display panel of claim 10, wherein:

during an initialization process of the pixel circuit:

at a first time, a voltage of the source line is set to a reference voltage, a voltage of the gate line is set to a first high voltage, a voltage of the first control line is set to be the reference voltage, a voltage of the second control line is set to be the first high voltage, and a voltage of the third control line is set to be a second high voltage;

at a second time, the voltage of the gate line is changed from the first high voltage to the low voltage; and at a third time, the voltage of the source line is changed from the reference voltage to the low voltage;

the second high voltage is higher than the first high voltage, the first high voltage is higher than the reference voltage, and the reference voltage is higher than the low voltage.

12. The display panel of claim 9, wherein:

when the pixel circuit is in a first polarity mode:

a voltage between the first terminal and the second terminal of the first capacitor is set to be a first data voltage, a second data voltage, a third data voltage, or a fourth data voltage according to pixel data to be shown;

when the pixel circuit is in a second polarity mode:

the voltage between the first terminal and the second terminal of the first capacitor is set to be a fifth data voltage, a sixth data voltage, a seventh data voltage, or an eighth data voltage according to pixel data to be shown;

the first data voltage and the eighth data voltage substantially have a same magnitude but different polarities;

the second data voltage and the seventh data voltage substantially have a same magnitude but different polarities;

the third data voltage and the sixth data voltage substantially have a same magnitude but different polarities;

the fourth data voltage and the fifth data voltage substantially have a same magnitude but different polarities;

a magnitude of the fourth data voltage is greater than a magnitude of the first data voltage;

the magnitude of the first data voltage is greater than a magnitude of the third data voltage;

the magnitude of the third data voltage is greater than a magnitude of the second data voltage;

the fourth data voltage and the third data voltage have a same polarity;

the third data voltage and the second data voltage have different polarities; and the second data voltage and the first data voltage have a same polarity.

13. The display panel of claim 12, wherein:

during the first polarity mode of the display panel:

at a first time, a voltage of the source line is changed to a low voltage;

at a second time, the voltage of the source line is changed from the low voltage to the first data voltage;

at a third time, a voltage of the first control line is changed from a reference voltage to a first intermediate voltage;

at a fourth time, the voltage of the source line is changed from the first data voltage to the second data voltage;

at a fifth time, the voltage of the first control line is changed from the first intermediate voltage to a second intermediate voltage the;

at a sixth time, the voltage of the source line is changed from the second data voltage to the third data voltage;

at a seventh time, the voltage of the first control line is changed from the second intermediate voltage to a third intermediate voltage; and at an eighth time, a voltage of the second control line is changed from a high voltage to the low voltage;

the low voltage is lower than the first to eighth data voltages;

the high voltage is higher than the first to eighth data voltages;

the first intermediate voltage is substantially equal to the eighth data voltage minus the seventh data voltage plus the second data voltage and minus the first data voltage;

the second intermediate voltage is substantially equal to the eighth data voltage minus the sixth data voltage plus the third data voltage and minus the first data voltage; and the third intermediate voltage is substantially equal to the eighth data voltage minus the fifth data voltage plus the third data voltage minus the first data voltage, and plus a threshold voltage of the first transistor.

14. The display panel of claim 12, wherein:

during the second polarity mode of the display panel:

at a first time, the voltage of the source line is changed from the third data voltage to the eighth data voltage, and the voltage of the first control line is changed from the third intermediate voltage to a fourth intermediate voltage;

at a second time, a voltage of the gate line is changed from the low voltage to a push voltage;

at a third time, the voltage of the first control line is changed from the fourth intermediate voltage to a fifth intermediate voltage;

at a fourth point, the voltage of the gate line is changed from the push voltage to the seventh data voltage;

at a fifth time, the voltage of the source line is changed from the eighth data voltage to the seventh data voltage;

at a sixth time, the voltage of the gate line is changed from the seventh data voltage to the sixth data voltage;

at a seventh time, the voltage of the source line is changed from the seventh data voltage to the sixth data voltage;

at an eighth time, the voltage of the gate line is changed from the sixth data voltage to the fifth data voltage;

at a ninth time, the voltage of the source line is changed from the sixth data voltage to the fifth data voltage;

at a tenth time, the voltage of the gate line is changed from the fifth data voltage to the low voltage; and at an eleventh time, the voltage of the first control line is changed from the fifth intermediate voltage to the reference voltage, and the voltage of the second control line is changed from the low voltage to the high voltage;

the fourth intermediate voltage is substantially equal to the eighth data voltage minus the first data voltage, and plus three times the threshold voltage;

the fifth intermediate voltage is substantially equal to the eighth data voltage minus the first data voltage, and plus the threshold voltage; and the push voltage is substantially equal to the eighth data voltage plus the threshold voltage.

15. The display panel of claim 9, wherein:

a voltage between the first terminal and the second terminal of the first capacitor is set to be a first data voltage, a second data voltage, a third data voltage, or a fourth data voltage according to pixel data to be shown; and the fourth data voltage is greater than the third data voltage, the third data voltage is greater than the second data voltage, and the second data voltage is greater than the first data voltage.

16. The display panel of claim 15, wherein:

during a refreshing process of the display panel:

at a first time, a voltage of the source line is changed to a low voltage;

at a second time, the voltage of the source line is changed from the low voltage to the fourth data voltage;

at a third time, a voltage of the second control line is changed from a high voltage to the low voltage;

at a fourth time, a voltage of the first control line is changed from a reference voltage to a first intermediate voltage;

at a fifth time, a voltage of the gate line is changed from the low voltage to a push voltage;

at a sixth time, the voltage of the first control line is changed from the first intermediate voltage to a second intermediate voltage;

at a seventh time, the voltage of the gate line is changed from the push voltage to the third data voltage;

at an eighth time, the voltage of the source line is changed from the fourth data voltage to the third data voltage;

at a ninth time, the voltage of the gate line is changed from the third data voltage to the second data voltage;

at a tenth time, the voltage of the source line is changed from the third data voltage to the second data voltage;

at an eleventh time, the voltage of the gate line is changed from the second data voltage to the first data voltage;

at a twelfth time, the voltage of the source line is changed from the second data voltage to the first data voltage;

at a thirteenth time, the voltage of the gate line is changed from the first data voltage to the low voltage;

at a fourteenth time, the voltage of the first control line is changed from the second intermediate voltage to the reference voltage, and the voltage of the second control line is changed from the low voltage to the high voltage;

the low voltage is lower than the first to fourth data voltages;

the high voltage is higher than the first to fourth data voltages;

the first intermediate voltage is substantially equal to three times a threshold voltage of the first transistor;

the second intermediate voltage is substantially equal to the threshold voltage; and the push voltage is substantially equal to the fourth data voltage plus the threshold voltage.

* * * * *